US007402089B1

(12) United States Patent
Myer et al.

(10) Patent No.: US 7,402,089 B1
(45) Date of Patent: Jul. 22, 2008

(54) CONTACT WITH ENHANCED TRANSITION REGION

(75) Inventors: John Mark Myer, Millersville, PA (US); John Wesley Hall, Harrisburg, PA (US); Hurley Chester Moll, Hershey, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/875,075

(22) Filed: Oct. 19, 2007

Related U.S. Application Data

(60) Provisional application No. 60/927,858, filed on May 4, 2007.

(51) Int. Cl.
*H01R 4/10* (2006.01)

(52) U.S. Cl. ..... 439/877

(58) Field of Classification Search ..... 439/877, 439/882, 851, 852, 867, 399, 407
See application file for complete search history.

(56) References Cited

U.S. PATENT DOCUMENTS 3,058,091 A * 10/1962 Henschen ..... 439/851
5,188,545 A * 2/1993 Hass et al. ..... 439/851
5,308,267 A * 5/1994 Hotea ..... 439/851
5,437,566 A * 8/1995 Zinn et al. ..... 439/839
5,437,567 A * 8/1995 Peterson ..... 439/851
5,516,311 A * 5/1996 Maejima ..... 439/877
5,545,062 A * 8/1996 Takagishi et al. ..... 439/877
5,593,328 A * 1/1997 Okada et al. ..... 439/851
5,611,716 A * 3/1997 Egenolf ..... 439/857
5,628,656 A * 5/1997 Macioce et al. ..... 439/851
5,653,616 A * 8/1997 Hotea ..... 439/851
5,800,220 A * 9/1998 Feeny et al. ..... 439/849
5,904,600 A * 5/1999 Tomita et al. ..... 439/877
5,989,078 A * 11/1999 Chaillot et al. ..... 439/851
6,010,377 A * 1/2000 Dechelette et al. ..... 439/851
6,095,874 A * 8/2000 Quaranta ..... 439/852
6,287,157 B1 * 9/2001 Suzuki et al. ..... 439/851
6,428,366 B1 * 8/2002 Purushothaman et al. ... 439/851
6,872,103 B1 * 3/2005 Flieger et al. ..... 439/839
7,014,515 B2 * 3/2006 Lutsch et al. ..... 439/843
7,115,004 B2 * 10/2006 Takayama ..... 439/852
7,198,525 B2 * 4/2007 Nagamine et al. ..... 439/843
7,207,850 B2 * 4/2007 Takayama ..... 439/852
7,210,971 B1 * 5/2007 Micek ..... 439/851
7,252,564 B1 * 8/2007 Morello et al. ..... 439/877
7,261,604 B2 * 8/2007 Brake et al. ..... 439/843
2001/0002350 A1 * 5/2001 Kashiyama et al. ..... 439/848
2001/0004566 A1 * 6/2001 Aoyama ..... 439/406
2002/0077001 A1 * 6/2002 Chen ..... 439/852
2003/0109181 A1 * 6/2003 Bungo ..... 439/852
2004/0127107 A1 * 7/2004 Lischeck et al. ..... 439/851
2005/0032441 A1 * 2/2005 Simmel ..... 439/843
2005/0054247 A1 * 3/2005 Lutsch et al. ..... 439/843

(Continued)

*Primary Examiner*—Hae Moon Hyeon
*Assistant Examiner*—Vladimir Imas

(57) ABSTRACT

An electrical contact having a mating portion and crimp portion with a transition region connecting the two portions. The transition region has a bottom wall and two side walls, each side wall having a first height and second height, the second height being less than the first height. The side walls of the transition region are folded over to secure a plurality of conductors, and the second height of the side walls allows the plurality of conductors to be viewed for inspection. Further, the bottom wall and side walls of the transition region have side embossments that reinforce the strength of the walls.

20 Claims, 6 Drawing Sheets

U.S. PATENT DOCUMENTS

2006/0121797 A1* 6/2006 Casses et al. ..... 439/851
2007/0111613 A1* 5/2007 Kumakura ..... 439/851
2007/0238353 A1* 10/2007 Yamaoka ..... 439/595

* cited by examiner

CONTACT WITH ENHANCED TRANSITION REGION

CROSS REFERENCE TO RELATED APPLICATIONS

This application claims the benefit of U.S. Provisional Application No. 60/927,858 filed May 4, 2007.

FIELD OF THE INVENTION

The invention relates to electrical contacts, and more particularly to wire contacts having an enhanced transition region.

BACKGROUND OF THE INVENTION

Currently electrical contacts or wire contacts are used to terminate wire. Wire contacts require a strong mechanical means of attaching to the wire to create a permanent termination and a means to mate to a mating contact to make an electrical connection. For example, a wire contact may have a crimp end for terminating to the wire and a male or female mating end. Some contacts may be developed from metal strip or pre-plated metal strip, which is stamped and then folded or formed into the appropriate shape.

One type of wire contact comprises crimping the wire strands to a conductive terminal. These contacts, such as "F" style crimp wire contacts, comprise a terminal box or mating portion, a crimp portion and a transition portion or zone between the mating portion and the crimp portion. The transition portion of most "F" crimp wire contacts require low walls to aid in forming the crimp portion. These contacts pose two problems. The first problem is that when thin strip material is used in the manufacture of the contacts, the transition region is prone to tearing or shearing of the material at the front of the crimp barrel. The second problem is that the low walls allow the wire strands to become strayed, which results in seal damage by tearing, slicing, or removing gland material from mat seals.

Therefore, what is needed is a design that does not allow the strands of the wire barrel to separate between the crimp and the rear of the terminal box and extend outside of the desired area.

SUMMARY OF THE INVENTION

One embodiment of the present invention includes an electrical contact with a mating portion forming a terminal box open on at least one end and configured to accept a mating electrical contact, a crimp portion, and a transition region connecting the mating portion with the crimp portion. The transition region has a bottom wall extending from the bottom wall of the mating portion to the bottom wall of the crimp portion, a first side wall having a first side wall first height extending from the bottom wall of the transition region to a top surface, and a second side wall having a second side wall first height extending from the bottom wall of the transition region to a top surface. The crimp portion and the transition region are configured to accept a plurality of conductors and secure substantially all of the conductors of the plurality of conductors when crimped together.

Another embodiment of the present invention includes an electrical contact with a pin contact mating portion configured to accept a mating terminal box contact, a crimp portion, and a transition region connecting the mating portion with the crimp portion. The transition region has a bottom wall extending from the bottom wall of the mating portion to the bottom wall of the crimp portion, a first side wall having a first side wall first height extending from the bottom wall of the transition region to a top surface, and a second side wall having a second side wall first height extending from the bottom wall of the transition region to a top surface. The crimp portion and the transition region are configured to accept a plurality of conductors and secure substantially all of the conductors of the plurality of conductors when crimped together.

An advantage of the present invention is an enhanced transition region with additional strength.

Another advantage of the present invention is an enhanced seal in the transition region.

Other features and advantages of the present invention will be apparent from the following more detailed description of the preferred embodiment, taken in conjunction with the accompanying drawings which illustrate, by way of example, the principles of the invention.

DETAILED DESCRIPTION

Figure 1:
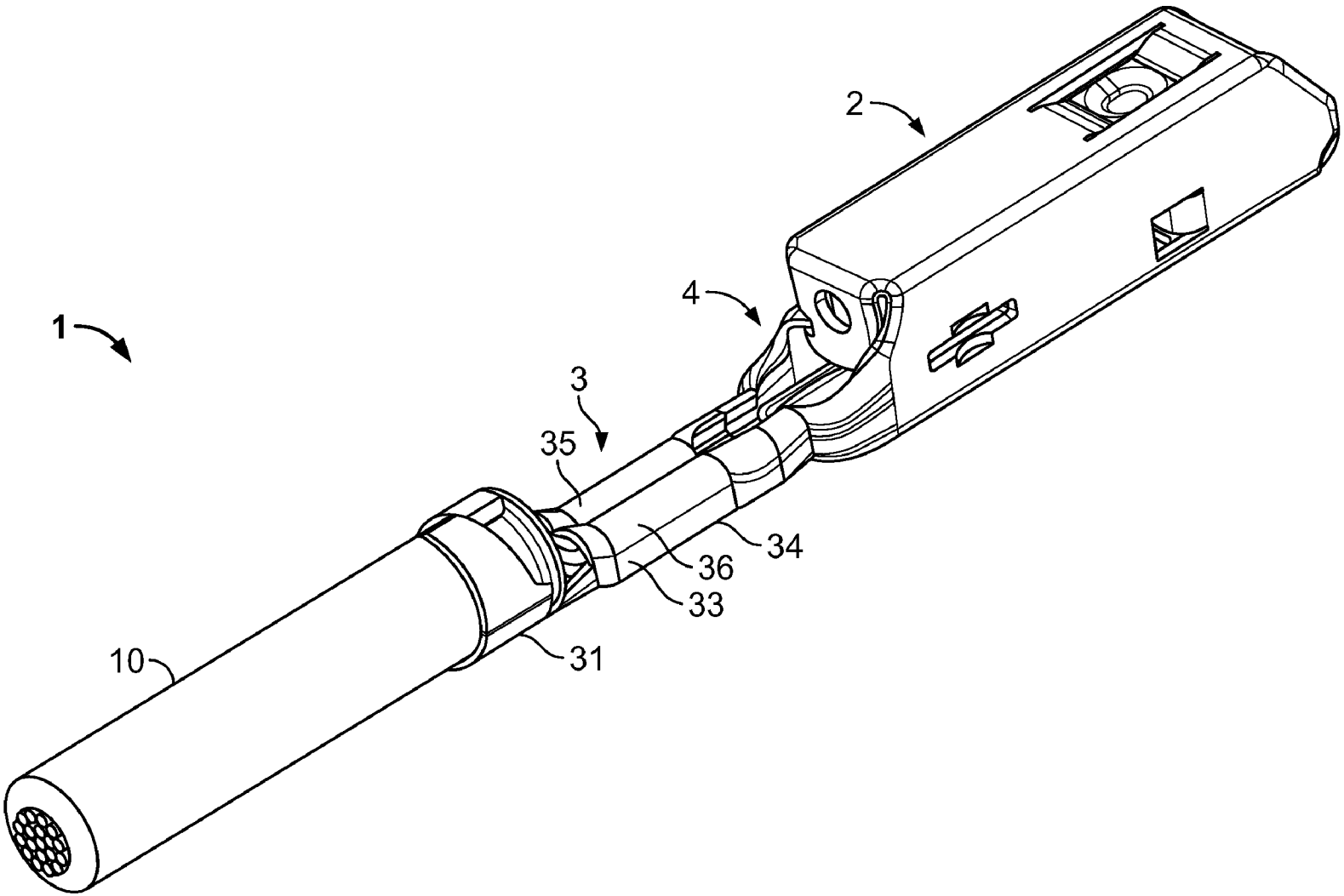
FIG. 1 illustrates a perspective view of an exemplary embodiment of the contact.
Figure 2:
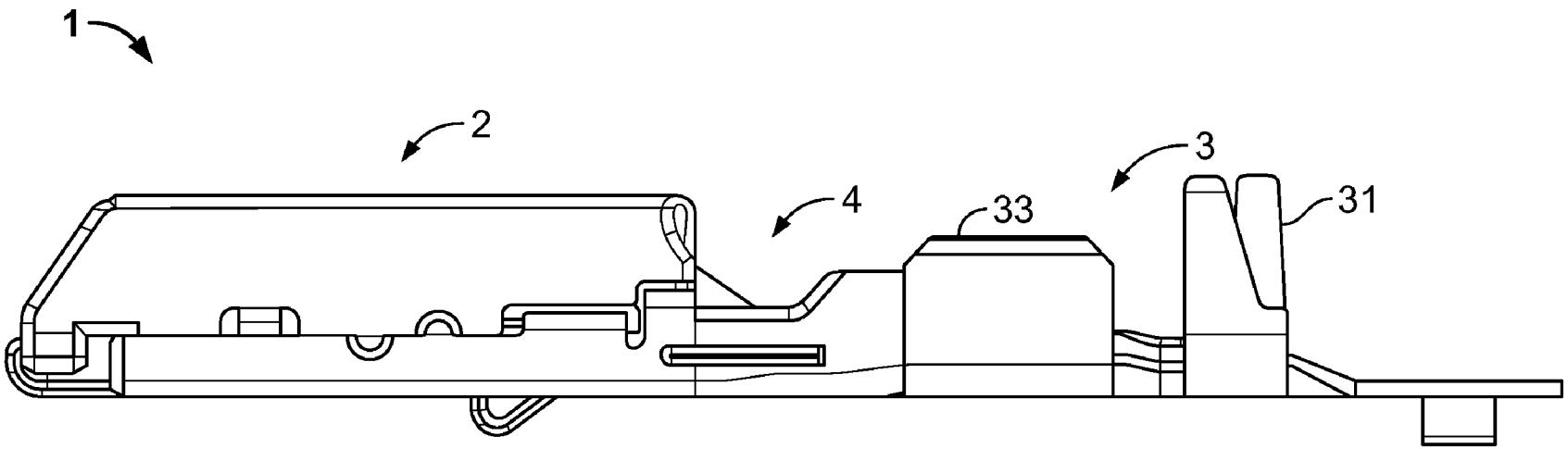
FIG. 2 illustrates a side view of an exemplary embodiment of the contact.

As shown in FIGS. 1-5, electrical contact 1 comprises a mating portion 2, a crimp portion 3 and a transition portion 4. The mating portion 2 comprises a terminal box for accepting a mating pin contact (not shown). The mating portion 2 may have numerous configurations as would be known to one skilled in the art. However, as shown in the exemplary embodiment, the mating portion 2 is generally a box shape with a top wall 21, two side walls 22, 23 and a bottom wall 24. Another embodiment of the electrical contact 1 may include the mating portion 2 comprising a pin contact for mounting in a terminal box.

The crimp portion 3 comprises a wire strain relief 31 and a crimp or wire barrel 33. The crimp barrel 33 may have numerous configurations as would be known to one skilled in the art. As shown in FIGS. 1-5 the crimp barrel 33 comprises a bottom wall 34 and a first side wall 35 extending from the bottom wall 34 to an open end top edge 37 and a second side wall 36 extending from the bottom wall 34 to an open end top edge 38. For wire termination, a portion of the insulation on the wire 10 is stripped or removed from the wire 10 to expose a plurality of conductors 50. The wire 10 is placed into the crimp portion 3 along the bottom wall 34 extending through the strain relief 31 so that the insulation is held by the strain relief 31. The stripped plurality of conductors 50 extending from the wire 10 are placed between the first side wall 35 and the second side wall 36 with the end of the wire 10 resting in the transition region 4. In order to verify a good quality crimp, the plurality of conductors 50 must pass through the crimp portion 3 and into the transition region 4 to confirm that substantially all of the plurality of conductors 50 have fully passed through the crimp barrel 33. Consequently, to ensure proper termination of the wire 10, the transition region 4 must be open to inspect the plurality of conductors 50 prior to, and after crimping. A crimper tool e.g. a manual crimp tool or an automatic crimp tool, may be used to bend the top edge 37 and the top edge 38 towards the plurality of conductors 50 so that the top edges 37, 38 are curved inward to contact, compress and hold the plurality of conductors 50 to create a strong conductive path.

The crimping action caused by the crimping tool may cause the plurality of conductors 50 of the wire 10 to be splayed out within the transition region 4. This may interfere with the terminal being smoothly inserted or removed from a contact cavity. More particularly, the stray conductors may damage a seal as the terminal passes through. The transition region 4 of the contact 1 provides a means to contain the end strands of the plurality of conductors 50 to allow the terminal to smoothly pass through a seal and to prevent damage to the seal.

Figure 3:
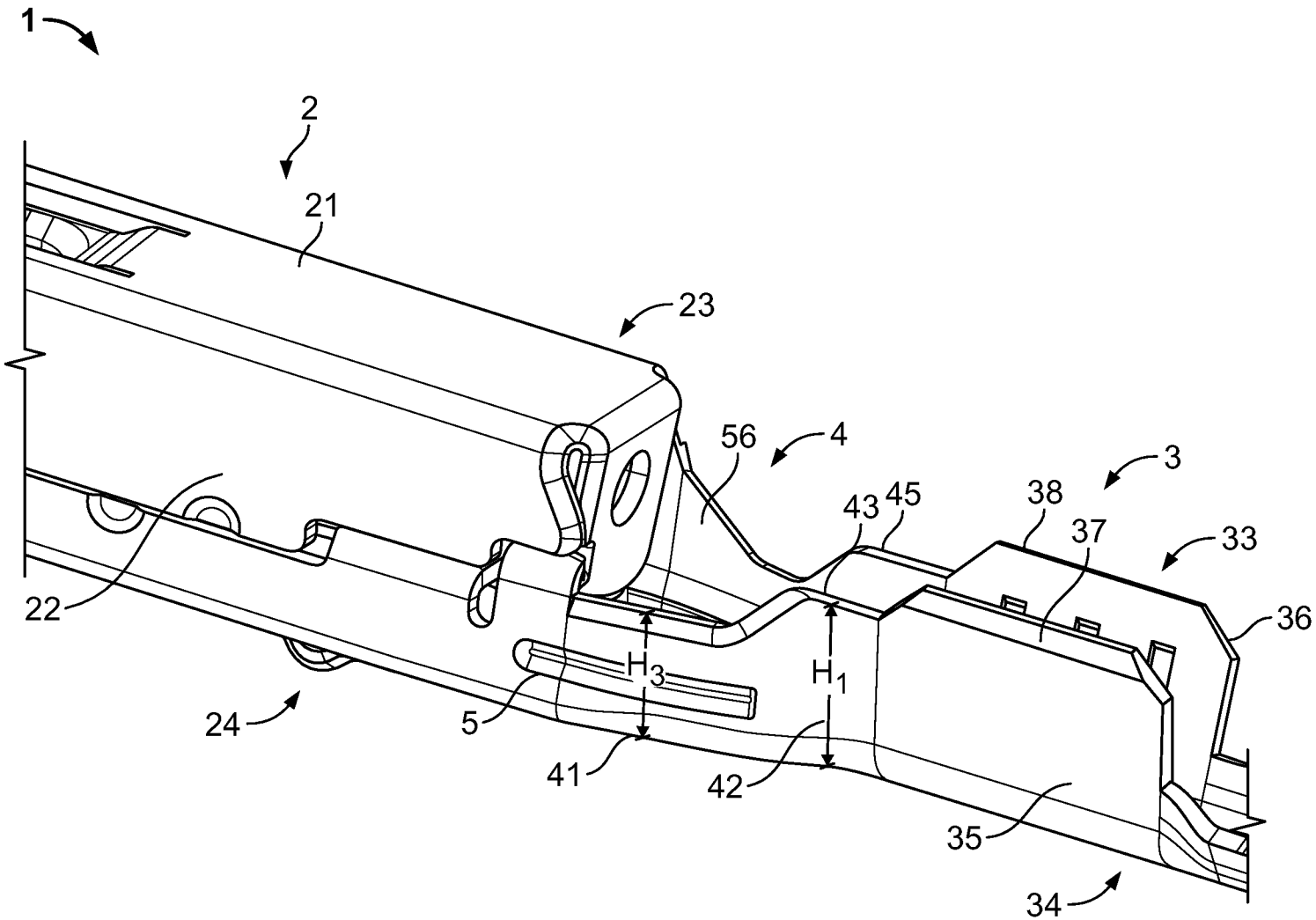
FIG. 3 illustrates a partial perspective side view of the contact of FIG. 2.
Figure 3A:
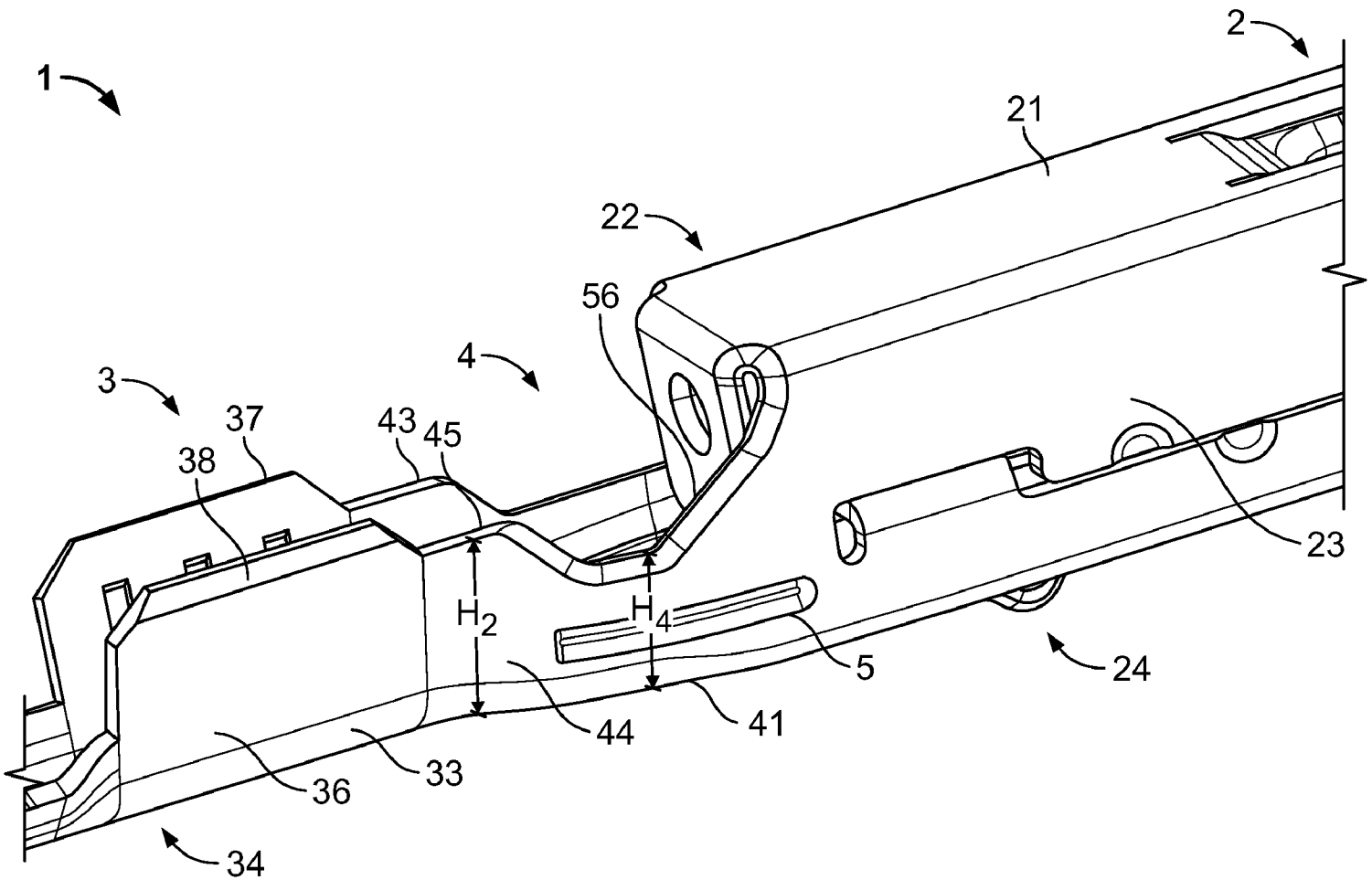
FIG. 3*a* illustrates a partial perspective side view of the contact of FIG. 2.

The transition region 4 extends between the mating portion 2 and the crimp portion 3. The transition region 4 comprises a bottom wall 41 extending from the bottom wall 24 of the mating portion 2 to the bottom wall 34 of the crimp portion 3. The transition region 4 has a first side wall 42, having a first side wall first height H1, extending from the bottom wall 41 to a top surface 43 adjacent to the first side wall 35 of the crimp portion 3, and a second side wall 44, having a second side wall first height H2, extending from the bottom wall 41 to a top surface 45 adjacent to the second side wall 36 of the crimp portion 3. In the exemplary embodiment shown in FIGS. 3 and 3*a*, the side walls 42, 44 comprise a taper extending from the first height H1, H2 to a second height H3 and H4 respectively. The side wall 44 has a slope 56 near the mating portion 2 that is helpful in guiding the contact 1 through a seal. In alternative embodiments, the side walls 42, 44 may have a consistent height so that H1 equals H3 and H2 equals H4. In addition, the transition region 4 may have other configurations, as long as the height of the side walls 42, 44 are higher close to the crimp portion 3. The higher height close to the crimp portion 3 enables the side walls 42, 44 to fold over and hold the plurality of conductors 50 and the lower height of the side walls 42, 44 furthest from the crimp portion 3 allow the plurality of conductors 50 to be viewed for inspection.

Figure 4:
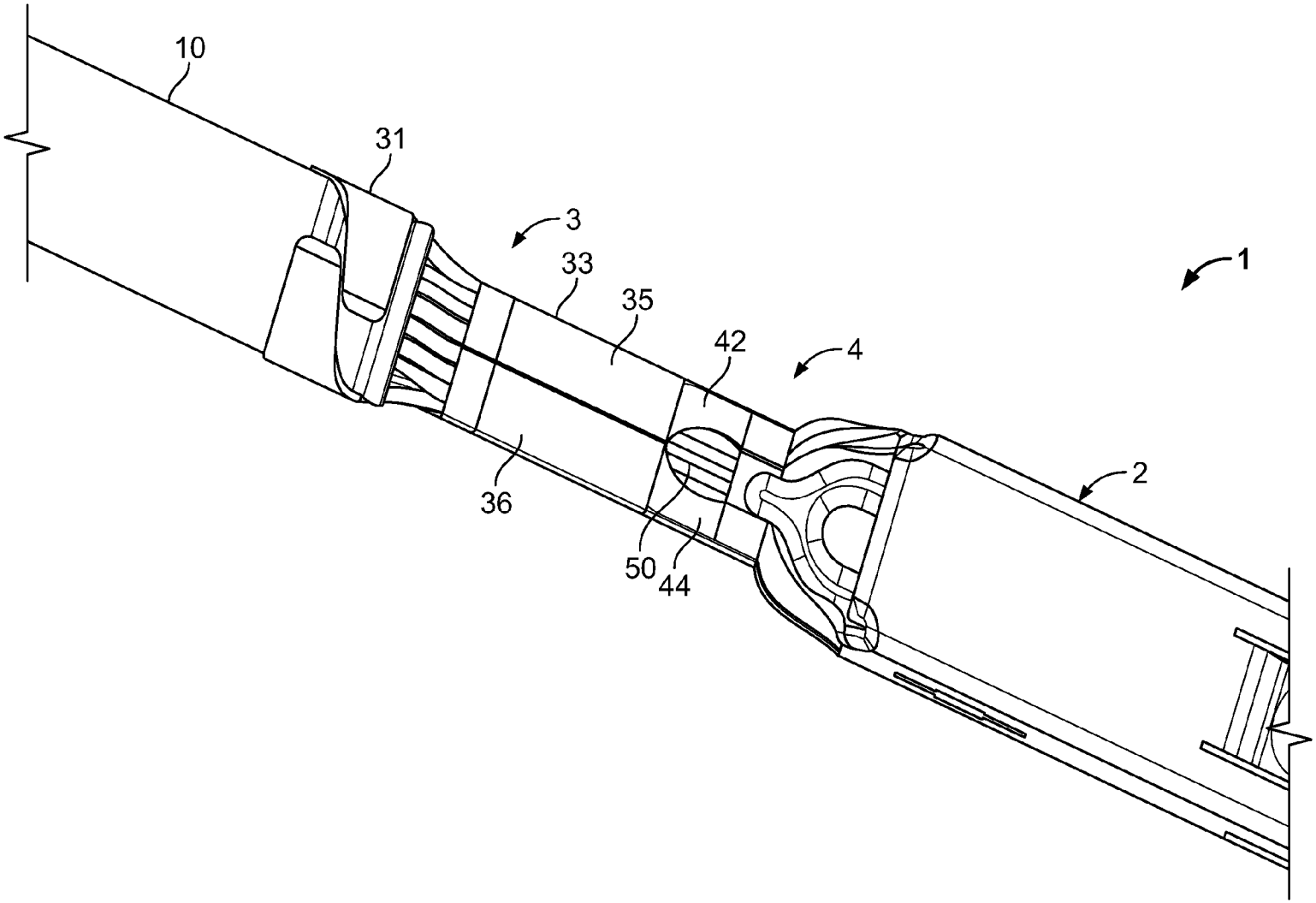
FIG. 4 shows a plan view of the contact of FIG. 1.
Figure 5:
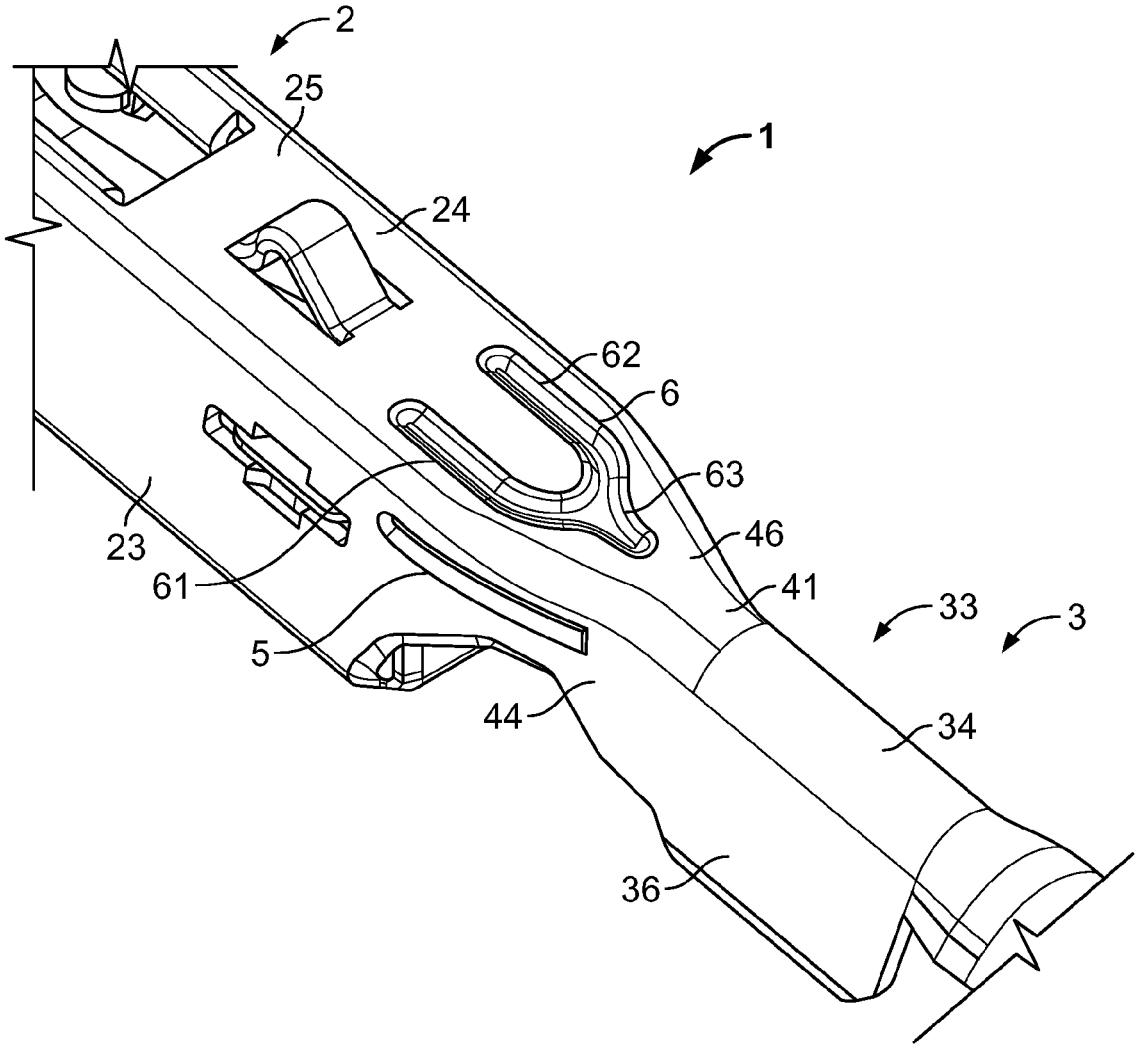
FIG. 5 shows a partial perspective bottom view of the contact of FIG. 1.

As shown in FIG. 4, when the crimp barrel 33 is crimped as described above, the transition side walls 42, 44 are folded over to contain the plurality of conductors 50. This provides the containment for the plurality of conductors 50. Since the side walls 42, 44 of the transition region 4 have shorter wall heights H2 and H4, when the side walls 42, 44 are crimped or folded over, the side walls 42, 44 do not meet. This creates a window for verifying proper placement of the wires to ensure proper termination and allowing inspection of the plurality of conductors 50. Additionally, the larger height of the side walls 42, 44 provides a stronger transition region 4 when the side walls are folded over, preventing tearing of the transition region 4.

In the exemplary embodiments, embossments 5 and 6 are provided to provide additional strength to the transition region. Side embossments 5 are located on transition region side walls 42 and 44 to reinforce the transition region 4 to prevent tearing during bending of the terminal as will be better explained below. In the exemplary embodiment, the side embossment 5 is a thin generally rectangular strip located longitudinally along the side walls 42, 44, creating a indent on the outer surface of the side walls 42, 44 and a raised bump on the inner surface of the side walls, 42, 44, however, as known to those skilled in the art, other configurations of the side embossments would provide the required strengthening properties.

A bottom embossment 6 may be added to further strengthen the transition region 4. In the exemplary embodiment, the bottom embossment 6 is generally wish-bone shaped having two legs 61, 62 extending longitudinally along the mating portion bottom wall 24 and meeting on the transition region bottom wall 41 to a single leg 63 extending in the opposite direction of legs 61, 62 along the transition region bottom wall 44. In the exemplary embodiment, the embossment 6 forms an indent on the outer surfaces 25, 46 of the mating portion bottom wall 24 and the transition region bottom wall 41. However, it is known by those skilled in the art that any suitable configuration of bottom embossment 6 may be used to provide the required strengthening properties.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical contact comprising:

a mating portion having a top wall and a bottom wall joined by two opposing side walls, the top, bottom and two side walls forming a terminal box open on at least one end and configured to accept a mating electrical contact;

a crimp portion having a bottom wall, a first wall extending from a side of the bottom wall, a second wall extending from another side of the bottom wall and having an open top;

a transition region connecting the mating portion with the crimp portion and configured with a bottom wall extending from the bottom wall of the mating portion to the bottom wall of the crimp portion, a first side wall having a first side wall first height extending from the bottom wall of the transition region to a top surface, and a second side wall having a second side wall first height extending from the bottom wall of the transition region to a top surface and wherein the first side wall first height and the second side wall first height are adjacent to the crimp portion and extend to just below a top surface of the side walls of the crimp portion; and wherein the crimp portion and the transition region are configured to accept a plurality of conductors and secure substantially all of the conductors of the plurality of conductors when crimped together.

2. The electrical connector of claim 1, wherein the first and second side walls of the transition region are folded over the plurality of conductors when the crimp is made.

3. The electrical contact of claim 2, wherein the folded over portion of the side walls contain the plurality of conductors within the transition region to prevent splaying of the plurality of conductors.

4. The electrical connector of claim 1, further comprising a side embossment on the first and second side walls to increase the strength of the first and second side walls.

5. The electrical connector of claim 4 wherein the side embossment comprises a thin strip disposed along the first and second side walls, creating a indent on an outer surface of the first and second side walls and creating a raised bump on an inner surface of the first and second side walls.

6. The electrical connector of claim 1, further comprising a bottom embossment on at least one bottom wall to increase the strength of the transition region bottom wall.

7. The electrical connector of claim 6 wherein the bottom embossment is substantially wish-bone shaped and having two legs extending substantially longitudinally along the mating portion bottom wall and meeting on the transition region bottom wall to a single leg extending in the opposite direction of two legs along the transition region bottom wall, creating an indent on an outer surface of the mating portion bottom wall and the transition region bottom wall.

8. The electrical connector of claim 1 wherein the first side wall first height tapers to a first side wall second height and the second side wall first height tapers to a second sidewall second height.

9. The electrical connector of claim 8 wherein the first and second side walls of the transition region are folded over the plurality of conductors when the crimp is made and the lower height of the side walls allow the plurality of conductors to be viewed for inspection.

10. The electrical connector of claim 1 wherein the first side wall first height and the second side wall first height are equal and the first side wall second height and the second side wall second height are equal.

11. An electrical contact comprising:

a pin contact mating portion configured to accept a mating terminal box contact;

a crimp portion having a bottom wall, a first wall extending from a side of the bottom wall, a second wall extending from another side of the bottom wall and having an open top;

a transition region connecting the mating portion with the crimp portion and configured with a bottom wall extending from the bottom wall of the mating portion to the bottom wall of the crimp portion, a first side wall having a first side wall first height extending from the bottom wall of the transition region to a top surface, and a second side wall having a second side wall first height extending from the bottom wall of the transition region to a top surface and wherein the first side wall first height and the second side wall first height are adjacent to the crimp portion and extend to just below a top surface of the side walls of the crimp portion; and wherein the crimp portion and the transition region are configured to accept a plurality of conductors and secure substantially all of the conductors of the plurality of conductors when crimped together.

12. The electrical connector of claim 11, wherein the first and second side walls of the transition region are folded over the plurality of conductors when the crimp is made.

13. The electrical contact of claim 12, wherein the folded over portion of the side walls contain the plurality of conductors within the transition region to prevent splaying of the plurality of conductors.

14. The electrical connector of claim 11, further comprising a side embossment on the first and second side walls to increase the strength of the first and second side walls.

15. The electrical connector of claim 14 wherein the side embossment comprises a thin strip disposed along the first and second side walls, creating a indent on an outer surface of the first and second side walls and creating a raised bump on an inner surface of the first and second side walls.

16. The electrical connector of claim 11, further comprising a bottom embossment on at least one bottom wall to increase the strength of the transition region bottom wall.

17. The electrical connector of claim 16 wherein the bottom embossment is substantially wish-bone shaped and having two legs extending substantially longitudinally along the mating portion bottom wall and meeting on the transition region bottom wall to a single leg extending in the opposite direction of two legs along the transition region bottom wall, creating an indent on an outer surface of the mating portion bottom wall and the transition region bottom wall.

18. The electrical connector of claim 11 wherein the first side wall first height tapers to a first side wall second height and the second side wall first height tapers to a second sidewall second height.

19. The electrical connector of claim 18 wherein the first and second side walls of the transition region are folded over the plurality of conductors when the crimp is made and the lower height of the side walls allow the plurality of conductors to be viewed for inspection.

20. The electrical connector of claim 11 wherein the first side wall first height and the second side wall first height are equal and the first side wall second height and the second side wall second height are equal.

* * * * *